US005925221A

United States Patent [19]

Sayers et al.

[11] Patent Number: 5,925,221

[45] Date of Patent: Jul. 20, 1999

[54] PAPERMAKING FABRIC

[75] Inventors: Ian Christison Sayers, Lancashire, United Kingdom; Robert David Buchanan, Raleigh, N.C.

[73] Assignee: Scapa Group PLC, Blackburn, United Kingdom

[21] Appl. No.: 09/114,101

[22] Filed: Mar. 13, 1998

Related U.S. Application Data

[63] Continuation-in-part of application No. 08/742,914, Nov. 1, 1996., abandoned

[51] Int. Cl.[6] ..... D21F 7/08

[52] U.S. Cl. ..... 162/902; 162/358.2; 162/900; 162/903; 442/268; 139/383 R

[58] Field of Search ..... 162/358.2, 900, 162/902, 903; 442/268; 139/383 R

[56] References Cited

U.S. PATENT DOCUMENTS

| | | | |
|---|---|---|---|
| 4,008,094 | 2/1977 | Beall et al. | 106/99 |
| 4,015,038 | 3/1977 | Romanski et al. | 428/255 |
| 4,070,519 | 1/1978 | Lefkowitz et al. | 428/235 |
| 4,105,495 | 8/1978 | Pai | 162/348 |
| 4,149,866 | 4/1979 | Austin et al. | 65/2 |
| 4,229,254 | 10/1980 | Gill | 162/358.4 |
| 4,259,394 | 3/1981 | Khan | 162/348 |
| 4,395,308 | 7/1983 | Dawes | 162/902 |
| 4,460,023 | 7/1984 | Mullaney | 162/902 |
| 4,816,312 | 3/1989 | Annemaier et al. | 428/74 |
| 5,431,992 | 7/1995 | Houpt et al. | 428/224 |
| 5,433,991 | 7/1995 | Boyd, Jr. et al. | 428/193 |

*Primary Examiner*—Marion McCamish
*Assistant Examiner*—Ula Ruddock
*Attorney, Agent, or Firm*—Jacobson, Price, Holman & Stern, PLLC

[57] ABSTRACT

A papermaking fabric primarily for use as a press felt comprises basalt fibers.

12 Claims, No Drawings

PAPERMAKING FABRIC

This application is a continuation-in-part of application Ser. No. 08/742,914, filed Nov. 1, 1996, now abandoned.

The invention relates to a papermaking fabric, particularly for the pressing or the drying section of a papermaking machine.

A wide variety of structures and materials have been proposed for such fabrics, generally comprising a woven, non-woven or mesh support or base layer, carrying one or more fibrous batt layers to absorb water from the paper and lead the moisture away from the paper/fabric contact zone.

Papermaking fabrics are subject to substantial wear, deformation and chemical attack, and often, in drying or press-drying operations, to temperatures over 120° C. and pressures in the range from 20 to 250 kN/m. Accordingly, it is advantageous to enhance the robustness and resistance qualities of the fabric to the greatest degree possible, and it is an object of the invention to provide a papermaking fabric with improved resistance to at least some of the stresses mentioned above.

Accordingly, the invention provides a paper making fabric comprising in combination, any one or more of the following:

- a fibrous batt, comprising a nonwoven layer including at least a proportion of basalt fibres and/or
- a base structure in the form of a mesh or grid formed by perforation in a sheet of resin bonded and/or mechanically consolidated nonwoven fibres, at least a proportion of which are basalt fibres; and/or
- a layer comprising core yarns or fibres wrapped with basalt fibres.

In the case of a fibrous batt, this may be supported on a nonwoven resin impregnated support fabric, and the fibrous batt may consist of a nonwoven layer of a blend of fibres including basalt fibres or micro-fibres, and natural or synthetic fibres. The latter may comprise one or more of nylon, polyester, polyolefin, polyketone, polyphenylene oxide, polyphenylene sulphide, a fluoropolymer, or PEEK.

In another embodiment, the fabric may comprise a fibrous batt layer, supported by a base structure in the form of a sheet of resin bonded and/or mechanically consolidated nonwoven material comprising a blend of fibres, formed into a mesh or grid formed by perforations provided in the sheet, the blend of fibres including basalt fibres together with any one or more of polyamide, glass or natural fibres.

Alternatively, the fabric may comprise a fibrous batt layer supported by a woven belt, the latter incorporating yarns comprising basalt staple fibres, alone or blended with natural or synthetic fibres.

The woven belt may be encapsulated or impregnated with a synthetic resin.

In the case of yarns or fibres sheathed with basalt fibres the cores of the filaments may comprise either monofilaments or multifilaments, braided, twisted, plied or spun natural or synthetic yarns.

To reduce the brittleness of the basalt fibres in order to form a sheath for a yarn, the basalt fibres are preferably treated with sizing agent, e.g. a silicone. The fibres may be treated with one or more high temperature bonding agents e.g. selected from the group comprising polybenzimidazoles, polyimides, polybenzoxazoles, melamine resins, phenolic resins and polyamide-imides, to improve bonding between the basalt fibres and the core material, or improve inter fibre bonding in basalt yarns.

The bonding agents may be applied by impregnating or coating the basalt yarns or fibres with a solution of the bonding agent(s) in an organic solvent comprising e.g. DMA, DMF or NMP, and then drying the yarns or fibres to remove the solvent.

The papermaking fabric is ideally for use as a press felt, the felt having a batt located on a support. The basalt fibres may be present in a blend of fibres making up a non-woven fibrous batt which contacts the paper, and/or it may be incorporated in a blend of fibres forming a woven or non-woven support for a batt, with or without bonding by a synthetic resin material, or in the structure of a membrane, e.g. plastics support mesh, being present therein as a reinforcement or filler.

Exceptionally, basalt fibres may be the only fibres present in a fibrous body forming part of a papermaking fabric according to the invention, e.g. where particularly high operating temperatures are envisaged, due to the refractory nature of the basalt fibres.

Processes for making basalt fibre are disclosed in e.g. Duraiswamy, Popular Plastics, February 1982, Page 6, "BASALT FIBRE: NEW COMPETITOR TO GLASS FIBRE" and U.S. Pat. Nos. 4,008,094 and 4,149,866.

Basalt is a naturally occurring intrusive igneous rock, formed as dykes or sills in sedimentary rocks in volcanically active zones, and is widely distributed world wide. Currently its main use is for road stone because of its hardness. It occurs in the British Isles for example as whinstone in the North of England.

Basalt consists essentially of silica (about 50% wt) and alumina (about 15% wt) similar proportions to those found in man-made glass. Its dark colour is caused by the presence of significant quantities (10% wt) of ferrous (black) iron oxide.

Basalt fibre obtained by the processes mentioned above can be made as staple fibres averaging 30 mm in length, or as micro fibres of eg 0.42 microns in diameter, for example, or in intermediate sizes.

Some examples will now be described by way of example of the invention.

EXAMPLE 1

A papermaking drying fabric comprises a fibrous batt, supported on a non-woven resin impregnated support fabric. The fibrous batt consists of a non-woven layer of a blend of fibres including basalt fibres or micro fibres, and any one or more of natural or synthetic fibres. The synthetic fibres are typically nylon, polyester, polyolefin, polyketone, polyphenylene oxide (PPO), polyphenylene sulphide (PPS), fluoropolymer or PEEK. The inclusion of basalt fibres enhances the mechanical and heat resistance of the batt.

EXAMPLE 2

A press felt comprises a fibrous batt layer supported by a base structure in the form of a mesh or grid formed by perforations in a sheet of a resin-bonded and/or mechanically consolidated non-woven of a blend of fibres, including basalt fibres, with any one or more of polyamide fibres, glass fibres, or other natural or synthetic fibres.

EXAMPLE 3

A press felt comprises a fibrous batt layer supported by a woven belt which incorporates yarns comprising basalt staple fibres. The remaining yarns may be of synthetic or natural fibres. The woven belt may be encapsulated or impregnated with a synthetic resin.

EXAMPLE 4

A high temperature papermaking fabric has a fibrous batt layer and a support belt each made predominantly of basalt fibres.

EXAMPLE 5

High temperature papermachine clothing, for example, dryer fabrics or press drying fabrics comprises filaments wrapped with basalt fibres. As it has been found that basalt fibres are to brittle to be used unmodified in this way as an overwrap yarn, the basalt fibres are first treated with a sizing agent such as one or more silicones, to thereby reduce brittleness. In this Example, high temperature bonding agents e.g. any one or more of polybenzimidazoles, polyimides, polybenzoxazoles, melamine resins, phenolic resins or polyamide-imides are used to improve bonding between the basalt fibres and the core fibre material, or to improve inter fibre bonding in basalt yarns. These bonding agents are applied by impregnating or coating the basalt yarns or fibres with a solution of one or more of the above mentioned high temperature bonding materials in a suitable organic solvent such as DMA, DMF or NMP and then drying the yarns or fibres to remove the solvent. The filaments may comprise monofilaments, multifilaments, braided, twisted, plied or spun yarns.

It will be appreciated that any combination of parts of a papermaking fabric may be provided in accordance with the invention where one or more of the parts includes or consists of basalt fibres. Additional layers such as cushioning layers to prevent or reduce marking or embossing of the paper by the structure of the support or base layer may be provided in addition to the base layer and fibrous batt. These may or may not incorporate basalt fibres.

It has been found in practice that basalt fibres have a high temperature resistance up to 900° C., are chemically inert, and are very strong. Their tensile strength of elastic modulus is superior to glass at 10,000 kg/m and they exhibit high resistance to rupture, with a 9 micron diameter fibre having a strength of 200–250 kg/m. Basalt fibres are also less hygroscopic than glass fibres (0.1–0.05 that of glass) so that their water take up is negligible.

Soft flexible glass fibres, e.g. "Miraflex" (trade mark) have a high soda content, which is leached out by steam. Basalt surprisingly does not have leaching problems, so that none of its mineral components are likely to contaminate paper webs provided on a fabric containing basalt fibres. It also substantially retains its mechanical properties in a steam environment. Furthermore, there are no health and safety risks posed by basalt fibres or yarns, unlike many other glass or mineral fibres.

These properties allow papermaking fabrics with inclusion of basalt fibres, in accordance with the invention, to have improved properties for use in papermaking, particularly with regard to strength, dewatering and absence of leaching. The glazing over encountered with some high temperature fibre materials, such as PEEK, which limits fabric porosity and leads to problems with press dryer fabrics, is also avoided. It is also noted that basalt is not prone to hydrolysis unlike many other high temperature materials such as aramids or polyamides.

What is claimed is:

1. A water permeable papermaking fabric comprising in combination, any one or more of the following:

a. a fibrous batt, comprising a non-woven layer including at least a proportion of basalt fibres; and /or b. a woven fabric layer, incorporating yarns comprising basalt staple fibres, alone or blended with natural or synthetic fibres; and/or c. a base structure in the form of a mesh or grid formed by perforation in a sheet of resin bonded and /or mechanically consolidated non woven fibres, at least a proportion of which are basalt fibres; and/or d. at least one fabric layer comprising filaments wrapped with basalt fibres.

2. A papermaking fabric according to claim 1, which comprises a fibrous batt, supported on a resin impregnated non-woven support fabric, said fibrous batt consisting of at least one non-woven layer of a blend of fibres including basalt fibres, and either natural or synthetic fibres.

3. A papermaking fabric according to claim 2, wherein said synthetic fibres comprise any one or more selected from the group comprising: nylon; polyester; polyolefin; polyketone; polyphenylene oxide, polyphenylene sulphide; glass; a fluoropolymer, or PEEK.

4. A papermaking fabric according to claim 1, which comprises a fibrous batt layer, supported by a base structure In the form of a sheet of resin bonded and/or mechanically consolidated non-woven material comprising a blend of fibres, formed into a mesh or grid formed by perforations provided in the sheet, said blend of fibres including basalt fibres together with any one or more of: nylon; glass fibres; polyester; polyolefin; polyketone; polyphenylene oxide; polyphenylene sulphide; fluoropolymer; PEEK; or natural fibres.

5. A papermaking fabric according to claim 1 which comprises a fibrous bat layer supported by a woven belt fabric, comprising a blend of yarns or fibres, said blend of yarns or fibres including yarns including basalt fibres together with any one or more of nylon; glass fibres; polyester; polyolefin; polyketone; polyphenylene oxide; polyphenylene sulphide; fluoropolymer; PEEK; or natural fibres.

6. A papermaking fabric according to claim 5 wherein said woven belt is impregnated with a synthetic resin.

7. A papermaking fabric according to claim 6, wherein the cores of said filaments comprise either monofilaments, or multifilaments, or braided, twisted plied or spun natural or synthetic yarns.

8. A papermaking fabric according to claim 7, wherein one or more high temperature bonding agents, selected from the group comprising polybenzimidazoles, polyimides; polybenzoxazoles, melamine resins, phenolic resins and polyamide-imides are used to improve bonding between the basalt fibres and the core fibre material or improve inter fibre bonding in basalt yarns.

9. A papermaking fabric according to claim 6, wherein said basalt fibres are treated with sizing agent such as silicone to reduce the brittleness of the fibres.

10. A paper making fabric according to claim 9 wherein said bonding agents are applied by impregnating or coating the basalt yarns or fibres with a solution of said bonding agent(s), in an organic solvent comprising DMA, DMF, or NMP, and then drying the yarns or fibres to remove the solvent.

11. A papermaking fabric according to claim 1, wherein said woven fabric comprises a woven belt supporting a fibrous batt layer.

12. A papermaking fabric according to claim 1, woven or otherwise formed from filaments wrapped in a sheath of basalt fibres.

* * * * *